US009802439B2

(12) United States Patent
Albenge et al.

(10) Patent No.: US 9,802,439 B2
(45) Date of Patent: Oct. 31, 2017

(54) FLUID APPLICATION DEVICE AND USES THEREOF

(71) Applicant: Societe BIC, Clichy (FR)

(72) Inventors: Olivier Albenge, Outreau (FR); Anne-Lise Damiano, Lagny sur Marne (FR)

(73) Assignee: SOCIÉTÉ BIC, Clichy (FR)

( * ) Notice: Subject to any disclaimer, the term of this patent is extended or adjusted under 35 U.S.C. 154(b) by 219 days.

(21) Appl. No.: 14/387,040

(22) PCT Filed: Mar. 20, 2013

(86) PCT No.: PCT/FR2013/050596

§ 371 (c)(1),
(2) Date: Sep. 22, 2014

(87) PCT Pub. No.: WO2013/140092

PCT Pub. Date: Sep. 26, 2013

(65) Prior Publication Data

US 2015/0044370 A1 Feb. 12, 2015

(30) Foreign Application Priority Data

Mar. 23, 2012 (FR) ..... 12 52657

(51) Int. Cl.

| | |
|---|---|
| ***B43K 5/00*** | (2006.01) |
| ***B43K 5/14*** | (2006.01) |
| ***B43K 5/18*** | (2006.01) |
| ***A46B 11/04*** | (2006.01) |
| ***B43K 7/08*** | (2006.01) |
| ***B43K 24/02*** | (2006.01) |
| ***B43K 23/12*** | (2006.01) |
| ***B43K 8/04*** | (2006.01) |

(Continued)

(52) U.S. Cl.

CPC ..... *B43K 5/1845* (2013.01); *B43K 5/145* (2013.01); *B43K 5/1836* (2013.01); *B43K 8/04* (2013.01); *B43K 8/12* (2013.01); *B43L 19/0018* (2013.01)

(58) Field of Classification Search

CPC . B43K 5/145; B43K 5/00; B43K 5/02; B43K 5/14; B43K 8/12

USPC ..... 401/126, 134–140

See application file for complete search history.

(56) References Cited

U.S. PATENT DOCUMENTS 2,053,892 A * 9/1936 Beck ..... B43K 5/14 222/490
2,061,059 A * 11/1936 Carlson ..... B43K 5/14 220/288

(Continued)

FOREIGN PATENT DOCUMENTS

EP 1 634 724 A2 3/2006
EP 1 634 724 A3 8/2007

(Continued)

*Primary Examiner* — Allana Lewin Bidder
*Assistant Examiner* — Thomas M Abebe
(74) *Attorney, Agent, or Firm* — Polsinelli PC

(57) ABSTRACT

A fluid application device including a reservoir intended to contain a free fluid and a fluid delivery device, wherein the reservoir is sealed by a valve having a self-healing material. The fluid application device includes a tubular means for piercing the valve and for simultaneously placing fluid from the reservoir in communication with the fluid delivery device.

18 Claims, 2 Drawing Sheets

(51) Int. Cl.
*B43K 8/12* (2006.01)
*B43L 19/00* (2006.01)

(56) References Cited

U.S. PATENT DOCUMENTS 2,240,604 A * 5/1941 Berger ..... B43K 5/14 401/134
3,145,412 A * 8/1964 Levy ..... B43K 5/1845 401/135
4,547,703 A * 10/1985 Fujita ..... H01B 3/12 257/43
5,334,178 A * 8/1994 Haber ..... A61J 1/1406 604/324
7,172,360 B2 * 2/2007 McSweeney ..... A46B 11/002 401/183
2002/0168215 A1 * 11/2002 Witz ..... B43K 8/04 401/198
2003/0039813 A1 * 2/2003 Kitai ..... B32B 3/30 428/212
2003/0108377 A1 * 6/2003 Duez ..... B43K 1/003 401/198
2004/0142008 A1 * 7/2004 Chevalier ..... A61K 8/02 424/401
2007/0253760 A1 * 11/2007 Fredell ..... A47L 23/05 401/17
2008/0187389 A1 * 8/2008 Dylkiewicz ..... B43K 5/17 401/108
2010/0178098 A1 * 7/2010 Bedhome ..... B43K 7/08 401/205
2011/0236122 A1 * 9/2011 Rolion ..... B43K 23/12 401/243
2014/0371362 A1 * 12/2014 Wilson ..... C08L 67/08 524/287
2016/0152809 A1 * 6/2016 Gordon ..... C08L 23/0869 428/220

FOREIGN PATENT DOCUMENTS

EP 2 345 544 A1 7/2011
GB 578084 6/1946
GB 578084 A * 6/1946 ..... B43K 5/14

* cited by examiner

FLUID APPLICATION DEVICE AND USES THEREOF

CROSS REFERENCE TO RELATED APPLICATIONS

This application is a national stage application of International Application No. PCT/FR2013/050596, filed on Mar. 20, 2013, which claims the benefit of French Patent Application No. 1252657, filed on Mar. 23, 2012, the entire contents of both applications being incorporated herein by reference.

BACKGROUND OF THE INVENTION

Field of the Invention

The embodiments of the present invention relate to a fluid application device and uses thereof.

Depending on the structure of fluid application devices, there are different ways of placing a fluid contained in a reservoir in communication with a device for delivering the said fluid.

Description of the Related Art

In most of the devices comprising a reservoir for free ink, this is in direct or indirect contact with a fluid delivery device. When writing, the ink is spread on a writing surface notably by means of a rotating ball situated at the extremity of the fluid delivery device or by means of a capillary system capable of including a fibrous, porous or extruded point, for example, a foam applicator or an applicator of the brush-type, etc. The extremity of the fluid application device may also include a mechanical valve, a roller, etc.

In a first type of existing device, the principal reservoir containing the free ink possesses openings towards the exterior of the fluid application device, which can possibly result in leaks in the event of variation in the temperature and/or in the pressure or in the event of cap pumping (that is to say the repetitive capping and uncapping of the item). These devices generally incorporate an element made of a plastic in the form of chicanes (baffle), the purpose of which is to reduce the risk of leakage by artificially distancing the vent orifice from the free ink contained in the reservoir. Such a device, quite apart from its cost and the real technical challenge presented by its molding and repeatable processing, does not guarantee the reliability of the system. In fact, it does nothing more than extend the eventual occurrence of a leakage of ink. Finally, regarding devices of this type having an open reservoir, the utilization of a leakproof cap is indispensable in order to avoid any evaporation of the fluid that it contains.

A second type of device possesses a mechanical valve between the free ink reservoir and the fluid delivery device. The purpose of this system is to close the free ink reservoir in a leakproof fashion and to deliver ink on request, during actuation of the valve by the consumer, which ink is at times stored in a secondary fibrous reservoir before supplying the fluid delivery device. This mechanical valve system includes numerous problems that are inherent in the large number of components: high cost of manufacture and assembly, great dimensional variability and/or imperfect molding/machining of the components of the valve which may result in functional problems in the valve (clogging, mechanical blockage or leakage of ink). Furthermore, in certain cases, these systems with mechanical valves do not possess a secondary reservoir, which results in leaks or major flow problems in the case of writing under loading (for example during uncapping in the pressurized atmosphere of an aircraft).

A third device for the storage of free ink is realized by a single reservoir that is compartmentalized into a minimum of two zones, linked together via a continuous capillary connector extending as far as the writing device. This system for a free ink reservoir remains open at all times (absence of a valve or a sealing membrane), and thus requires the presence of a secondary porous reservoir which absorbs the leakages of ink during variations in temperature and in pressure. This system includes a large number of plastic components which need to be assembled with care, and it requires perfect dimensional consistency in the zone through which the capillary connector passes. In spite of that, this type of expensive system does not perform its function in the event of strong variations in temperature or in pressure, and runs may appear under these constraints.

Furthermore, in an effort to resolve the problem of the end of life of ink cartridges, where the removal of the cartridge soils the interior of the housing of a pen or the hands of the user, GB 578 084 and U.S. Pat. No. 2,053,892 describe pens utilizing ink cartridges sealed by a rubber stopper. When the cartridge is used for the first time, the stopper is perforated by a hollow point. The pen remains in this state, in which the stopper is perforated, during the entire life of the cartridge, generally until the cartridge is practically empty. When the cartridge is removed from the pen, given the resilience of the rubber, the stopper closes again and by so doing prevents the ink remaining in the cartridge from flowing. Thus, according to these documents, the stopper is pierced on only a single occasion during the use of a full cartridge. According to GB 578 084, it is possible to refill an empty cartridge until this itself is once again empty, and for as many as two or more times.

The devices described in these patents do not provide a solution to the risk of leakage throughout the entire life of the pen. In fact, when the cartridge is in use, the membrane and hence the reservoir remain permanently open.

It would be desirable, therefore, to have available a fluid application device which offers the possibility of easy industrialized production (reduced number of parts, easy assembly and excellent reproducibility in manufacture) guaranteeing a total absence of leakage of fluid from the reservoir for the said fluid in the event of strong variation in pressure or in temperature, while allowing the reliable supply of fluid from the fluid application device according to the needs of the user. Furthermore, it would be desirable to have a fluid application device in which the fluid contained in the reservoir would be protected from any evaporation even without a leakproof cap.

After extensive research, the present inventors have devised a fluid application device, in particular for writing, comprising a valve comprising a self-healing material which makes it possible to fulfill these requirements.

This valve is pierced every time the fluid application device is used and recloses of its own accord at the end of each use, by cessation of the writing or by the action of the user and until such time as the reservoir is empty.

For this reason, the present application has as its object a fluid application device comprising a reservoir intended to contain a free fluid and a fluid delivery device, characterized in that:

- the reservoir is sealed by a valve comprising a self-healing material;
- the fluid application device comprises tubular means for piercing the valve and for simultaneously placing fluid from the reservoir in communication with the fluid delivery device; and means for the relative displacement of the valve towards the tubular piercing means, as a result of which the tubular piercing means are able to release the fluid from the reservoir towards the fluid delivery device every time the fluid application device is used.

The present application likewise had as its object a method of writing comprising a plurality of phases of writing and of resting, characterized in that a fluid application device as defined above is provided, in order to write, a user proceeds to pierce the valve, by the relative displacement of the valve towards the tubular piercing means, thereby allowing the fluid to exit from the reservoir during the writing phase, and upon cessation of writing corresponding to a resting phase, the tubular piercing means are retracted from the valve, which closes by self-healing in order to close the reservoir. The reservoir may thus undergo variations in pressure without leakage of ink.

Writing usually takes place on a writing surface, for example a sheet of paper.

When, after a resting phase, the user wishes to resume using the fluid application devices, he once more proceeds as indicated above. The fact that the valve is made of a self-healing material means that the above process can be repeated a very large number of times, exceeding the capacity of the reservoir.

It should be noted that, in the present application, the indefinite article "a/an" must conventionally be considered as a generic plural form (signifying "at least one" or also "one or a plurality of"), except when the context indicates otherwise (1 or "a single"). Thus, for example, when it is stated above that the valve comprises a self-healing material, this is intended to denote one or a plurality of self-healing materials.

In the rest of the text, the expression "distal part" makes reference to the part of the fluid application device furthest away from a user. The expression "proximal part" conversely makes reference to the part closest to a user. The expression "median part" makes reference to a part situated between the distal part and the proximal part.

In the present application, the expression "fluid application device" designates any device enabling a fluid contained in a reservoir to be delivered to a writing surface, thanks to a fluid delivery device.

By way of example of a fluid application device, mention may be made of a ball point pen, a fountain pen, a felt-tipped pen, a coloring felt pen, a permanent marker, an erasable marker, a correction system, an eraser, etc.

According to a preferred embodiment of the invention, the fluid application device is a system having a fibrous point such as a coloring felt pen, a highlighter, a permanent or non-permanent marker, etc.

The reservoir is preferably an elongated tube in order to make the fluid application device compact. The reservoir thus follows the customary form of a fluid application device.

The reservoir comprises an outlet orifice. The expression "outlet orifice" denotes the place at which the reservoir is sealed by the valve.

The expression "fluid delivery device" denotes not only that the distal part of a fluid delivery device is in contact with a writing surface when writing, but also that the median part and the proximal part are not visible to the user and are situated in the distal part of the fluid application device. The writing surface may be of various natures, the most familiar being constituted by paper or cardboard.

The expression "fluid" designates a colored or colorless liquid. The said fluid has a viscosity adapted to its use. For example, mention may be made of liquids with a low viscosity such as ink, water, solvent, or of more viscous fluids such as corrector fluid or paint. Mention may also be made of fluids that are sensitive to UV or to the air, etc.

According to a preferred embodiment of the invention, the fluid is an ink.

The expression "free fluid" denotes the fact that the fluid is able to flow freely inside a container.

According to the invention, the expression "sealed" denotes the fact that the system constituted by the fluid reservoir and the valve is liquid tight under normal conditions of utilization.

According to the invention, the expression "valve" designates a device enabling the reservoir to be kept closed in order to prevent the fluid from escaping therefrom.

The valve may be of various forms. A preferred valve takes the form of a disk, that is to say a flattened cylinder. It may also take other forms, however, such as a cubic, parallelepiped or spherical form.

According to one embodiment, the valve has the same surface area as the surface area of the outlet orifice.

According to another embodiment, the valve has a larger surface area than the surface area of the outlet orifice.

Thus, according to one embodiment, the surface area of the valve lies between 0.7 and 2900 $mm^2$, preferably between 7 and 1300 $mm^2$ and more preferably between 19 and 315 $mm^2$ in order to limit the volume of self-healing material utilized.

The valve is characterized by a thickness "e", which is not necessarily uniform over the entire surface area of the valve.

In the case of an insufficient thickness, the valve will be difficult to pierce because of its high elasticity.

On the other hand, in the case of an excessive thickness, the valve will likewise be difficult to perforate.

Thus, according to one embodiment, the thickness of the valve is uniform and lies between 0.1 and 10 mm, preferably between 1 and 5 mm, in order to permit its perforation without too many external constraints.

The valve may be inserted, in particular, between peripheral lips in order to seal the reservoir. It may also be glued or soldered. It may also be realized by over molding, bi-injection or multi-injection.

The expression "self-healing material", denotes a material that is capable of self-repairing after having been damaged by perforation, in particular by recovering all of its proprieties of impermeability to fluids.

Unlike a material such as rubber, in which, after perforation, the resilience of the material recloses the site of the perforation (physical impermeability limited to small differences in pressure), a self-healing material likewise recovers its original configuration before piercing (physico-chemical recovery guaranteeing impermeability even under a high difference in pressure).

According to the invention, the self-repairing is preferably almost instantaneous in order to realize a very rapid sealing.

The expressions self-healing material, healing material or self-repairing material are used interchangeably below.

According to the invention, the self-healing material may, in particular, be selected from the group constituted by multifunctional fatty acids, acrylic monomers or polymers, polyether-based polyurethanes and copolymers, and preferably polyether-based di-block polymers because the mobility of the polymer chains permits the rapid self-healing of the lesions even at low temperature.

According to one embodiment, the valve is constituted in its entirety by a self-healing material, which facilitates the manufacture of the valve.

According to another embodiment, at least one part of the valve is constituted by a self-healing material and at least one part of the valve is constituted by a non-self-healing material in order to reduce the cost of manufacturing the said valve. The part constituted by a self-healing material is more specifically arranged, therefore, in order to be perforated by the piercing means.

Thus, according to one particular embodiment, the valve is constituted by a central part made of a self-healing material and by a peripheral part made of a non-self-healing material, for example polyethylene, polypropylene, polystyrene, polyamide, polymethyl methacrylate.

In such a case, the surface area of the valve, which is made of a self-healing material, for example represents from 1% to 99%, preferably from 5% to 80% and preferably from 10% to 60% of the total surface area of the valve.

According to another embodiment, the part of the valve made of a self-healing material may be situated entirely in line with the perforating parts of the piercing means in order to reduce to a maximum the quantity of self-healing material utilized. These zones may or may not be of revolving configuration and may be over molded in the non-self-healing material or inserted (clipped, blocked by force . . . ) into the same non-self-healing material.

According to yet another embodiment, the valve is of multilayer configuration (notably of bi-layer or of triple-layer configuration), the said valve comprising at least one layer of a self-healing material and at least one layer of a non-self-healing material. In the event that the valve is of bi-layer configuration (a layer of self-healing material and a layer of non-self-healing material), the non-self-healing material may be situated on the reservoir side or on the opposite side according to the desired mechanical properties. In the event that the valve is of triple-layer configuration, the layer of self-healing material is situated between two layers of non-self-healing materials so as to guarantee a sufficient mechanical rigidity during piercing. According to this embodiment, the one or more layers made of a non-self-healing material partially or in its entirety covers or cover the surface of the layer made of a self-healing material. The junction between the different materials may be realized by simple superposition or by gluing, soldering or some other means adapted to the different materials that are utilized.

According to this embodiment, the non-self-healing material may be selected in particular from the group constituted by materials made of polyethylene, polypropylene, polystyrene, polyamide and polymethyl methacrylate.

According to one particular embodiment, the thickness of the part of the valve made of a self-healing material and the thickness of the part made of a non-self-healing material are different.

According to yet another embodiment, the material of the valve is constituted by a mixture comprising a self-healing material and a non-self-healing material. This mixture is realized in such a way that it possesses in fine self-repairing (or self-healing) properties.

Thus, according to one particular embodiment of the invention, the material of the valve is constituted by a mixture comprising from 40% to less than 100% of one or a plurality of self-healing material(s), preferably from 60% to 95%, and especially from 75% to 90%, the rest being constituted by one or a plurality of non-self-healing material (s).

According to the invention, the non-self-healing material that is mixed with the self-healing material may be selected in particular from the group constituted by elastomers, polyolefins, polymethacrylates and styrenic polymers, preferably elastomers because the chemical compatibility with the self-healing material will be improved.

The expression "tubular piercing means" denotes any tubular means, preferably mobile, capable of bringing about the perforation of the valve at one or a plurality of sites.

According to the invention, the tubular piercing means are 1 or more in number.

According to one embodiment, when the number of piercing means is greater than or equal to two, the latter may be separated from one another or attached to one another.

According to the invention, the tubular piercing means have a hollow section or a plurality of hollow sections that are separated by partition walls.

One or more needle(s) having a unique hollow section can be mentioned by way of example as piercing means.

The said tubular piercing means may have different cross sections such as a circular, square or triangular section, in particular circular, and are preferably tapered at their perforating extremity in order to limit the lesion of the valve and to accelerate the repair process.

The tubular piercing means of piercing can be realized in various materials and preferably in stainless steel, which will be inert to any chemical products contained in the fluid.

According to one embodiment, the piercing means may have undergone a treatment of their internal surface in order to aid or not to aid the passage of the fluids and/or a treatment of their external surface in order to limit external attack.

According to the invention, the said piercing means can contain a porous and/or capillary system.

According to one embodiment, the tubular means have a length "1" of between 5 and 30 mm, preferably between 10 and 20 mm, in order to guarantee sufficient penetration into the reservoir for liquid ink, all without being obliged to increase the size of the fluid application device disproportionately.

According to another embodiment that is capable of being combined with the preceding embodiment, when the tubular piercing means have a circular section, the latter are characterized by an internal diameter Di and an external diameter De.

The expression "internal diameter" denotes the diameter of the hollow section without the wall of the needle.

The expression "external diameter" denotes the diameter of the hollow with the wall of the needle.

The internal diameter is directly linked to the rate of flow of the fluid. Thus, a small internal diameter will produce a small rate of flow of fluid, whereas a large internal diameter will result in a higher rate of flow of fluid.

For this reason, according to one embodiment, the internal diameter of the piercing means lies between 0.1 and 1.2 mm, preferably between 0.2 and 0.8 mm.

Thus, according to one embodiment, the external diameter of the piercing means lies between 0.2 and 1.5 mm, preferably between 0.25 and 0.90 mm, in order to impart high mechanical strength to the piercing means while avoiding causing damage to the self-healing material in the course of the piercing cycles.

According to another preferred embodiment, when the piercing means consist of at least two needles, the said needles have an identical length, an identical internal diameter and an identical external diameter.

According to one particular embodiment, when the piercing means consist of at least two needles, the internal diameter and/or the external diameter and/or the length of one needle is different from the others.

According to one preferred embodiment of the invention, the means for piercing the valve are tubular needles of circular section having an identical length, an identical internal diameter and an identical external diameter, and of which the extremity intended to pierce the valve is tapered.

According to the invention, by the nature of their tubular design, the piercing means likewise ensure the function of placing the fluid in the reservoir in communication with the fluid delivery device.

Thus, the fluid application device of the invention permits the delivery of a fluid when writing.

The range of possible writing flow rates may be determined in particular by the number and/or the internal dimension of the tubular piercing means. In the particular case in which the piercing means are of different lengths, the flow rate may also be regulated by means of the contact pressure.

The device of the invention likewise permits the delivery of a fluid in a smaller quantity and in a controlled manner when writing.

Thus, according to another embodiment, the fluid application device comprises in addition a buffer reservoir so that the placing of fluid in communication with the fluid delivery device is achieved by a buffer reservoir having a proximal part and a distal part. The proximal part of the buffer reservoir is placed in contact with the distal part of the piercing means, and the distal part of the buffer reservoir is placed in contact with the proximal part of the fluid delivery device.

Thus, according to this embodiment, when the valve is pierced by the piercing means, the free ink which flows from the reservoir is not directly in contact with the fluid delivery device but is absorbed in a buffer reservoir, which permits the fluid delivery device to be supplied with a small quantity and in a controlled manner.

The expression buffer reservoir denotes a porous reservoir comprising fibers or a foam, for example, possessing a porosity that is entirely interconnected and open. Its porous volume lies between 50% and 95%, preferably between 65% and 85%, so as to guarantee a sufficient free volume and good containment of the ink during shocks.

According to the invention, the means for the relative displacement of the valve towards the tubular piercing means are capable of being actuated by external forces applied to actuators.

The actuators are accessible via the exterior of the fluid application device so as to ensure that the fluid is delivered from the reservoir towards the fluid delivery device at the request of the user.

Thus, according to the invention, it is necessary to apply an external force to the means of displacement of the valve towards the tubular means so as to bring about the perforation of the said valve and the release of the fluid contained in the reservoir.

According to one embodiment, the valve is fixed and the piercing means are mobile.

In this embodiment, the piercing means are preferably set in motion by the force induced by the user when the fluid delivery device is brought into contact with a writing surface, the fluid delivery device performing the function of an actuator.

According to another embodiment, the valve is mobile and the piercing means are fixed.

In this embodiment, the valve is displaced by an actuator that is accessible to the user from the exterior of the said fluid application device. The actuator may be connected to a stem which, during the application of pressure by the user with the intention of writing, is able to deform the valve, thereby causing the perforation of the said valve by the piercing means, which are then fixed. When the user releases the pressure, the valve returns to its natural position, in which it is no longer pierced. The self-healing takes place, and the valve is once again undamaged.

Mention may be made by way of example, as an actuator, of a push button (situated on the proximal extremity of the fluid application device) extended by a stem which comes into contact with the valve in order to bring about its displacement until its perforation by the piercing means. The actuator can also be situated on a lateral wall of the fluid application device: the displacement of the push button at the time of actuation causes the deformation of the valve, for example, by simple lateral compression exerted by the user.

According to one embodiment, once the actuators are no longer subjected to any external force, the piercing means are retracted from the valve (or vice versa), the valve is reclosed, preferably instantaneously, and the system returns to its position of equilibrium, in so doing recovering all its impermeability to the fluid.

For this reason, the fluid application device may comprise in addition an element performing the function of a spring, such as a helicoidal spring or a resilient flexible strip. The spring element causes the distancing of the piercing means in relation to the fixed valve and the cessation of the piercing. The spring element is preferably situated between the actuator and the fluid delivery device.

According to one particular embodiment, when the actuator is not the fluid delivery device, the external forces are not applied in a continuous fashion to the actuators when writing. In fact, the user can exert a force on the actuator of the device producing the perforation of the valve by the piercing means and the flow of the fluid towards the device for delivering the fluid. He can then release the force while continuing to write on a writing surface, even if the fluid application device has returned to its state of equilibrium, that is to say, when the valve has repaired itself. Finally, the user will once again be able to exert a force on the actuator as soon as the fluid delivery device is no longer being supplied with fluid in a sufficient manner in order to be able to write.

This embodiment is particularly suitable when the fluid application device comprises a buffer reservoir, since the buffer reservoir permits the delivery of the fluid over a longer time interval.

According to another embodiment, the actuator permits the retraction of the piercing means from the self-healing valve, which is in a normal closed position. Any application of an external force to the actuator will have the effect of retracting the piercing means from the self-repairing valve and, as a result, of interrupting the flow of fluid from the reservoir towards the fluid delivery device. According to one particular embodiment, this actuator may be engaged at the time of recapping the fluid application device. Thus, for example, the retraction by the user of the cap from the fluid delivery device causes the piercing means to pierce the valve. When the user stops using the fluid delivery device, he replaces the cap, which then causes the retraction of the means for piercing the valve. The latter repairs itself and effectively recloses the fluid reservoir.

The fluid application device of the present invention permits the delivery on request of a fluid contained in a reservoir towards a fluid delivery device. According to certain embodiments, it also permits sealing of the reservoir containing the free fluid once the device is no longer being used. This sealing can take place very rapidly and very effectively due to the self-healing nature of the valve.

Thus, the fluid delivery device is not in permanent contact with the free fluid when writing and outside phases of writing. The use of a reservoir for free ink that is closed in a leakproof manner by a self-healing valve during the resting phases effectively avoids any risk of leakage in the event of variation in temperature or in pressure, even if this variation is considerable. Furthermore, the rate of flow of the ink remains constant, regardless of the conditions of use when the fluid application device comprises a secondary porous reservoir. Finally, given that the transfer of ink between the free ink reservoir and the secondary porous reservoir takes place only in the event of a perforation of short duration of the self-healing valve, the risk of leakage is eliminated in this case, too. This system does not delay the leaks, however, like conventional systems: it prevents them in a simple and reliable manner.

For this reason, the present application also has as its object the utilization of the fluid application device described previously in order to write, mark, color, highlight, correct, paint, and in particular the method of writing defined above, the expression writing comprising the variants indicated above: marking coloring, highlighting, etc.

According to another embodiment, the utilization of the fluid application device is intended for multiple uses.

The present application also has as its object a method for the delivery, on request, of a fluid from a reservoir towards a fluid delivery device comprising the following steps:

(i) provision of a fluid application device comprising a reservoir intended to contain a free fluid and a fluid delivery device, characterized in that:

the reservoir is sealed by a valve, the valve comprises a self-healing material;

the fluid application device comprises tubular means for piercing the valve and for placing fluid in communication between the reservoir and the fluid delivery device and means for the relative displacement of the valve towards the tubular piercing means, as a result of which the tubular piercing means are able to release the fluid from the reservoir towards the fluid delivery device.

(ii) application during a writing phase of a force in order to produce the piercing of the valve by the tubular piercing means, as a result of which the fluid passes via the tubular means in order to reach the fluid delivery device, (iii) cessation of the application of the force during a resting phase, as a result of which the self-repairing valve closes and stops supplying the fluid delivery device.

It should be noted here that the latter step comprises in particular the following two modalities:

a modality in which, when writing, the user exerts a force (for example by pressing the point of a pen on a sheet of paper) and, when he stops exerting this force, the sealing of the valve occurs, a modality in which, in order to write, a user removes a cap or presses on a lateral actuator in the gripping zone of the writing implement, for example. This action produces a reaction force on the valve, which moves into a position where it is pierced by the tubular piercing means, and, when the user replaces the cap or releases the pressure exerted on the lateral actuator, the valve once again moves into a position in which it closes by self-repair.

In preferred conditions for the implementation of the method described above, the force required to produce the piercing of the valve is opposed to a force produced by an element performing the function of a spring for keeping the tubular means for piercing the valve remote from the valve.

In other preferred conditions for the implementation of the method described above, the force required to produce the piercing of the valve by the tubular piercing means is produced by the user pressing the fluid delivery device onto a surface.

The preferred conditions for the implementation of the writing devices described above are likewise applicable to the other objects of the invention mentioned above, in particular to the above method for delivering a fluid from a reservoir towards a fluid delivery device.

The invention will be better understood by reference to the accompanying drawings, in which FIG. 1 depicts a longitudinal section of a fluid application device according to an embodiment, in which the valve is mobile and the piercing means are fixed.

Figure 1:
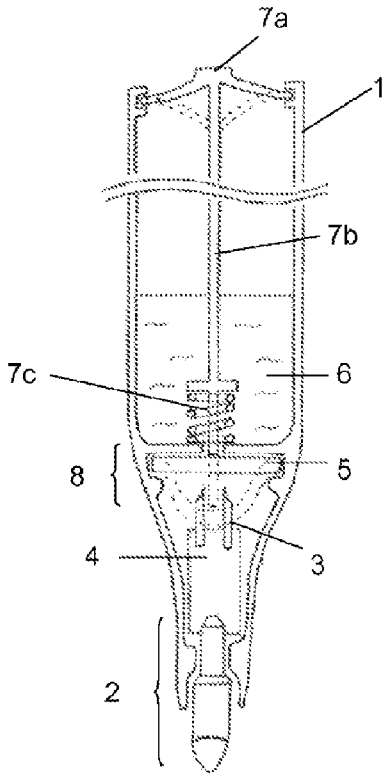
Figure 2:
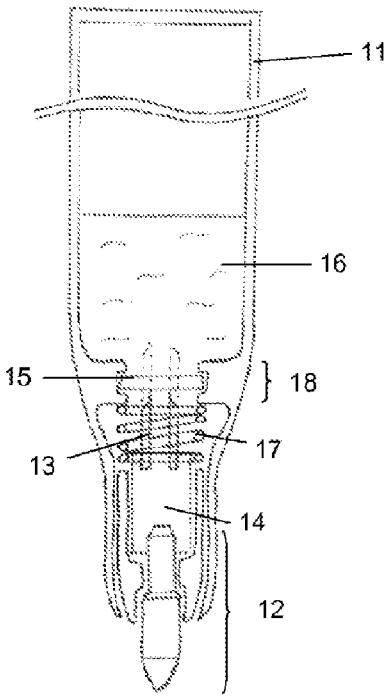
FIG. 2 depicts a longitudinal section of a fluid application device according to an embodiment, in which the valve is fixed and the piercing means are mobile.

FIGS. 1 and 2 depict a fluid application device (1; 11) of the fibrous point marker type comprising a free ink reservoir (6; 16) sealed by a valve (5; 15) installed at an outlet orifice of the said reservoir (8; 18). The valve (5; 15) is made of a self-healing material. The fluid application device (1; 11) comprises as piercing means two tubular needles (3; 13) of a similar type to hypodermic injection needles, exhibiting in FIGS. 1 and 2 an identical length, an identical internal diameter and an identical external diameter. The extremities intended to perforate the valve (5; 15) are tapered. The two pairs of needles (3; 13) are connected to a fluid delivery device (2; 12) via a buffer reservoir (4; 14). The non-tapered parts (distal parts) of the needles (3; 13) are inserted into the proximal part of the buffer reservoir (4; 14), and the proximal part of the fluid delivery device (2; 12) is inserted into the distal part of the buffer reservoir (4; 14).

Each of the devices represented in FIGS. 1 and 2 comprise an actuator.

In FIG. 1, where the valve is mobile and the piercing means are fixed, the actuator is a push button 7*a*. The actuator is in the form of a conical hat, the point of which is directed towards the exterior. It is made of a resilient plastic material. A pressure, for example applied with the help of the thumb, causes the depression of the cone (see position shown as a dotted line), which springs back when the pressure of the thumb ceases. In order to amplify the return of the cone into the exit position, the device 1 is equipped with a spring 7*c*.

The conical push button 7*a* is connected by its center to a stem 7*b*, which causes the valve 5 to move towards the tapered parts of the needles 3.

The valve 5, like the push button 7*a*, is installed by force in a circular groove defined by a proximal lip and a distal lip.

In the embodiment depicted in FIG. 2, the actuator is the fluid delivery device 12. In this case, the device comprises a spring 17 installed between the distal part of the valve 15 and the proximal part of the fluid delivery device 12. The spring 17 can be supported on the valve 15, as shown here, or not. The spring 17 in this case can be supported on the internal wall of the fluid application device (1; 11), for example on the distal lip of the retaining groove for the valve 15.

In the embodiment represented by FIG. 1, a pressure exerted on the actuator 7 has the effect of displacing the center of the valve 5 until it causes the perforation of the said valve 5 by the needles 3. The ink flows by gravity or capillary action through the said needles in order to supply the fluid delivery device 2 via the buffer reservoir 4.

As soon as the actuator 7 is no longer acted upon by an external force, the retraction of each needle 3 from the valve 5 takes place thanks to the spring 7*c*. The valve repairs itself almost instantaneously and recovers all of its properties of impermeability to the fluid. The system returns to its state of equilibrium.

In the embodiment represented by FIG. 2, the pressure generated by pressing the fluid delivery device 12 onto a writing surface has the effect of pushing the needles 13 towards the interior. Depending on the exerted pressure, one needle 13 or the pair of needles perforates the valve 15 and permits the ink to flow through the said needles in order to supply the fluid delivery device 12 via the buffer reservoir 14.

When the writing and hence the pressure exerted by the user ceases, the spring 17 repels the fluid delivery device, which results in the retraction of the needles 13 from the valve 15. The valve 15 repairs itself almost instantaneously and recovers all of its properties of impermeability to the fluid. The system returns to its state of equilibrium.

If it is wished to realize a fluid application device for extended use, provision can be made for the two extreme positions to be stable positions. For example, when the fluid application device is in the position shown as dotted lines, in FIG. 1, a pull on the conical push button 7*a* will cause the fluid application device to return to the position shown as solid lines in FIG. 1. For this purpose, the center of the conical push button 7*a* can be provided with a longer nipple than that illustrated, in order to make it easier to grip.

Figure 3:
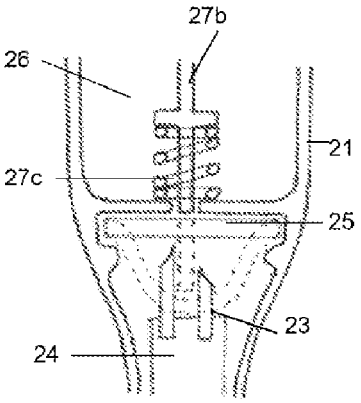
FIG. 3 depicts a longitudinal section of a fluid application device according to an embodiment, in which the piercing means have different lengths.

FIG. 3 depicts a longitudinal section of a part of the fluid application device, in which the piercing means 23 have a different length but identical external and internal diameters. The exerted force directed towards the bottom in this figure on the stem 27*b* causes the valve 25 to flex via the spring 27, causing the perforation of the latter by the piercing means 23, as shown by dotted lines.

Figure 4:
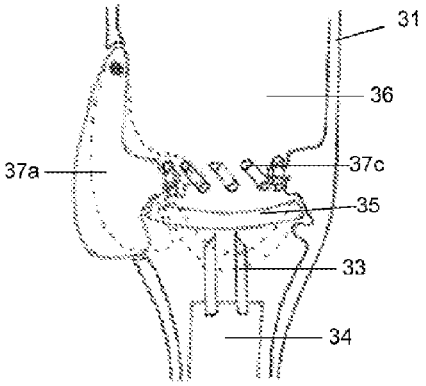
FIG. 4 depicts a longitudinal section of a fluid application device according to an embodiment, in which the actuator is situated on a lateral part of the fluid application device of the invention.

FIG. 4 depicts a longitudinal section of a part of the fluid application device 31, in which the actuation system 37*a* is situated on a lateral part of the said device 31. The pressure exerted on the actuation system 37*a* causes the deformation of the valve 35, as shown by dotted lines, until perforation of the said valve by the piercing means 33 takes place, thereby causing the fluid to flow from the reservoir 31 towards the fluid delivery device (not represented in the figure) via the buffer reservoir 34.

The spring 27*c* (FIG. 3) or 37*c* (FIG. 4) contributes to the return to a position of equilibrium in which the valve closes again.

FIGS. 5 to 8 depict a diametrical section of a mixed disk-shaped valve (FIGS. 5*a* to 8*a*) and the corresponding longitudinal section (FIGS. 5*b* to 8*b*).

Figure 5:
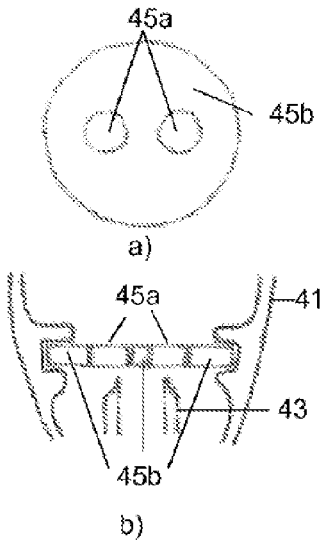
FIGS. 5 to 8 depict a diametrical section of a mixed valve according to different embodiments (FIGS. 5*a* to 8*a*) and the corresponding longitudinal section (FIGS. 5*b* to 8*b*).

In FIG. 5, it can be seen that the mixed valve is constituted by a part made of a non-self-healing material 45*b* and of two disk-shaped parts made of a self-healing material 45*a* and intended to be pierced by the piercing means 43. The diameter of the parts 45*a* is slightly larger than the diameter of the piercing means 43.

Figure 6:
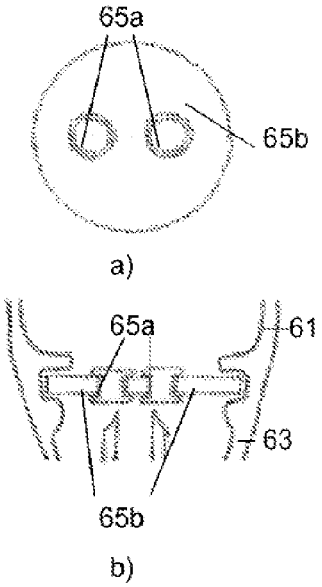

FIG. 6 illustrates the case in which the parts made of a self-healing material 65*a* intended to be perforated by the piercing means 63 enclose the part made of a non-self-healing material 65*b*, thereby ensuring a better mechanical grip during piercing cycles. They are in the form of a diabolo, for example.

Figure 7:
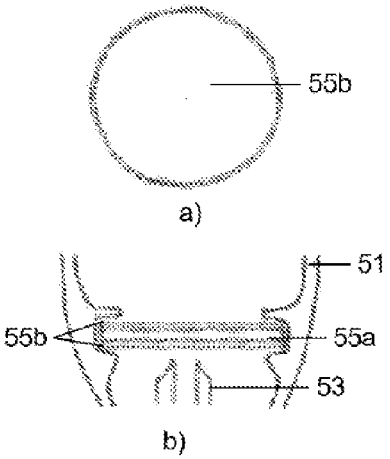

In FIG. 7, it can be seen that the mixed valve is of triple-layer configuration constituted by a part made of a self-healing material 55*a* held between the disk of the same diameter made of a non-self-healing material 55*b*.

Figure 8:
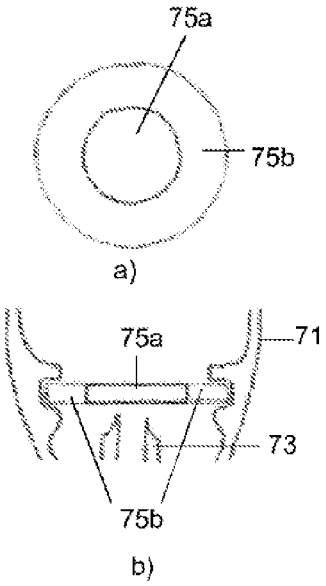

FIG. 8 illustrates the embodiment in which the mixed valve is constituted by a disk, of which the peripheral part is made of a non-self-healing material 75*b* and the central part intended to be perforated by the piercing means is made of a self-healing material 75*a*.

The invention claimed is:

1. A fluid application device comprising:

a reservoir intended to contain a free fluid and a fluid delivery device, wherein the reservoir is sealed by a valve comprising a self-healing material;

a tubular means for piercing the valve and for simultaneously placing fluid from the reservoir in communication with the fluid delivery device; and a displacement means for the relative displacement of the valve towards the tubular piercing means, the displacement means for the relative displacement of the valve towards the tubular piercing means being actionable by external forces applied to an actuator, whereby the tubular piercing means enables release of the fluid from the reservoir to the fluid application device at each use of the fluid-applying device; and a means, performed by a spring element, enabling the valve to be withdrawn from the tubular piercing means in the absence of the external forces.

2. The device according to claim 1, wherein the valve is constituted in its entirety by a self-healing material.

3. The device according to claim 1, wherein the valve is constituted by at least one part made of a self-healing material and by at least one part made of a non-self-healing material, the part consisting of a self-healing material being more specifically arranged in order to be perforated by the tubular piercing means.

4. The device as claimed in claim 3, wherein a surface area of the valve which is made of a self-healing material represents from 1% to 99% of the total surface area of the valve.

5. The device according to claim 1, wherein the material of the valve is constituted by a mixture comprising a self-healing material and a non-self-healing material.

6. The device according to claim 5, wherein the mixture comprises from 40 to less than 100% by weight of self-healing material in relation to the total weight of the mixture, the rest being constituted by one or a plurality of non-self-healing material(s).

7. The device according to claim 1, wherein the valve is of multilayer configuration, and wherein the valve includes at least one layer of a self-healing material and at least one layer of a non-self-healing material.

8. A fluid application device comprising a reservoir intended to contain a free fluid and a fluid delivery device, wherein the reservoir is sealed by a valve comprising a self-healing material, the self-healing material is selected from the group consisting of multifunctional fatty acids, acrylic monomers or polymers, polyurethanes, and polyether-based copolymers, a tubular means for piercing the valve and for simultaneously placing fluid from the reservoir in communication with the fluid delivery device; and a displacement means for the relative displacement of the valve towards the tubular piercing means, the displacement means for the relative displacement of the valve towards the tubular piercing means being actionable by external forces applied to an actuator, whereby the tubular piercing means enables release of the fluid from the reservoir to the fluid application device at each use of the fluid-applying device; and a means enabling the valve to be withdrawn from the tubular piercing means in the absence of the external forces.

9. A fluid application device comprising:

a reservoir intended to contain a free fluid and a fluid delivery device, the reservoir being sealed by a valve;

a tubular means for piercing the valve and for simultaneously placing fluid from the reservoir in communication with the fluid deliver device; and a displacement means for relative displacement of the valve towards the tubular piercing means, the displacement means for the relative displacement of the valve towards the tubular piercing means being actionable by external forces applied to an actuator, whereby the tubular piercing means enables release of the fluid from the reservoir to the fluid application device at each use of the fluid-applying device; and a means enabling the valve to be withdrawn from the tubular piercing means in the absence of the external forces, wherein the valve comprises at least one part made of a self-healing material and at least one part made of a non-self-healing material, the non-self-healing material is selected from the group consisting of elastomers, polyolefins, polymethacrylates and styrenic polymers, the part consisting of a self-healing material being more specially arranged in order to be perforated by the tubular piercing means.

10. The device according to claim 9, wherein the non-self-healing material is selected from the group including polyethylene, polypropylene, polystyrene, polyamide and polymethyl methacrylate.

11. The device according to claim 1, wherein the tubular piercing means comprise one or a plurality of needles having a length 1 of between 5 and 30 mm, an internal diameter Di of between 0.1 and 1.2 mm and an external diameter De of between 0.2 and 1.5 mm.

12. The device according to claim 1, further comprising a buffer reservoir for the placing of fluid in communication with the fluid delivery device, which is achieved by the buffer reservoir having a proximal part and a distal part, in which the proximal part of the buffer reservoir is placed in contact with the distal part of the piercing means and the distal part of the buffer reservoir is placed in contact with the proximal part of the fluid delivery device.

13. The device according to claim 1, wherein the valve is fixed and the piercing means are mobile.

14. The device according to claim 1, wherein the valve is mobile and the piercing means are fixed.

15. The device according to claim 1, wherein the device is used to write, mark, color, highlight, correct and paint.

16. A method of writing comprising a plurality of phases of writing and of resting, wherein a fluid application device according to claim 1 is provided, wherein in order to write, a user proceeds to pierce the valve, by the relative displacement of the valve towards the tubular piercing means, thereby allowing the fluid to exit from the reservoir during the writing phase, and upon cessation of writing corresponding to a resting phase, the tubular piercing means are retracted from the valve, which closes by self-healing in order to close the reservoir.

17. The device according to claim 1, wherein the spring element is a helicoidal spring or a resilient flexible strip.

18. The device according to claim 1, wherein the spring element is situated between the actuator and the fluid delivery device.

* * * * *